US006899539B1

(12) United States Patent
Stallman et al.

(10) Patent No.: US 6,899,539 B1
(45) Date of Patent: May 31, 2005

(54) INFANTRY WEARABLE INFORMATION AND WEAPON SYSTEM

(75) Inventors: Lawrence Stallman, Peoria, AZ (US); Jack Tyrrell, Phoenix, AZ (US); Theodore Hromadka, III, Glendale, AZ (US); Andrew Dobson, Glendale, AZ (US); Neil Emiro, Phoenix, AZ (US); Dana Edwards, Glendale, AZ (US)

(73) Assignee: Exponent, Inc., Menlo Park, CA (US)

( * ) Notice: Subject to any disclaimer, the term of this patent is extended or adjusted under 35 U.S.C. 154(b) by 0 days.

(21) Appl. No.: 09/505,678

(22) Filed: Feb. 17, 2000

(51) Int. Cl.[7] ..... F41A 33/00

(52) U.S. Cl. ..... 434/11; 345/156; 345/157; 345/161; 345/163; 345/769; 345/770

(58) Field of Search ..... 364/400; 707/501; 429/96; 89/41.05; 345/339, 769–770, 156–167, 184; 434/11; 463/1–2, 36–39; 273/148 B

(56) References Cited

U.S. PATENT DOCUMENTS

| | | | |
|---|---|---|---|
| 1,955,300 | A | 4/1934 | Kurnick |
| 2,282,680 | A | 5/1942 | Sonne |
| 3,545,356 | A | 12/1970 | Nielsen |
| 3,715,953 | A | 2/1973 | Allan |
| 3,843,969 | A | 10/1974 | George et al. |
| 4,008,478 | A | 2/1977 | Ikrath et al. |
| 4,232,313 | A | 11/1980 | Fleishman |
| 4,438,438 | A | 3/1984 | Arens et al. |
| 4,516,157 | A | 5/1985 | Campbell |
| 4,516,202 | A | 5/1985 | Kadowaki |
| 4,597,740 | A | 7/1986 | Stickel |
| 4,605,959 | A | 8/1986 | Colbaugh |
| 4,658,375 | A | 4/1987 | Onogi et al. |
| 4,686,506 | A | 8/1987 | Farago |
| 4,703,879 | A | 11/1987 | Kastendieck et al. |
| 4,741,245 | A | 5/1988 | Malone |
| 4,786,966 | A | 11/1988 | Hanson et al. |
| 4,804,937 | A | 2/1989 | Barbiaux et al. |
| 4,862,353 | A | 8/1989 | Williams |
| 4,884,137 | A | 11/1989 | Hanson et al. |
| 4,897,642 | A | 1/1990 | DiLullo et al. |
| 4,936,190 | A | 6/1990 | Pilcher, II |
| 4,949,089 | A | 8/1990 | Ruszkowski, Jr. |
| 4,977,509 | A | 12/1990 | Pitchford et al. |
| 4,991,126 | A | 2/1991 | Reiter |

(Continued)

FOREIGN PATENT DOCUMENTS

JP 10-130862 * 6/1999 ..... A63F/9/22

OTHER PUBLICATIONS

3DZoneMaster, www.proxy–ms.co.il/pegasus.htm, (1998), p. 1–4.*

(Continued)

*Primary Examiner*—Joe H. Cheng
*Assistant Examiner*—Cameron Saadat
(74) *Attorney, Agent, or Firm*—Hall, Myers, Vande Sande & Pequignot

(57) ABSTRACT

Wearable systems for providing situational awareness in battle or combat type conditions. More specially, modular, wearable, weapon integrated computer systems for gathering and transmitting data, wherein the systems include components tailorable for specific conditions or missions. Further provided are hardware and software for controlling such wearable systems and for communicating with remote system wearers.

9 Claims, 10 Drawing Sheets

U.S. PATENT DOCUMENTS 5,005,213 A 4/1991 Hanson et al.
5,026,158 A 6/1991 Golubic
5,032,083 A 7/1991 Friedman
5,043,736 A 8/1991 Darnell et al.
5,046,130 A 9/1991 Hall et al.
5,054,225 A 10/1991 Giuffre et al.
5,059,781 A 10/1991 Langdon
5,099,137 A 3/1992 Lattin, Jr.
5,129,716 A 7/1992 Holakovszky et al.
5,130,934 A 7/1992 Ikeuchi
5,153,836 A 10/1992 Fraughton et al.
5,155,689 A 10/1992 Wortham
5,200,827 A 4/1993 Hanson et al.
5,223,844 A 6/1993 Mansell et al.
5,272,514 A 12/1993 Dor
5,278,568 A 1/1994 Enge et al.
5,281,957 A 1/1994 Schoolman
5,285,398 A 2/1994 Janik
5,311,194 A 5/1994 Brown
5,317,321 A 5/1994 Sass
5,320,538 A 6/1994 Baum
5,334,974 A 8/1994 Simms et al.
5,386,308 A 1/1995 Michel et al.
5,386,371 A 1/1995 Mather et al.
5,416,730 A 5/1995 Lookofsky
5,422,816 A 6/1995 Sprague et al.
5,444,444 A 8/1995 Ross
5,450,596 A 9/1995 Felsenstein
5,457,629 A 10/1995 Miller et al.
5,470,233 A 11/1995 Fruchterman et al.
5,481,622 A 1/1996 Gerhardt et al.
5,491,651 A 2/1996 Janik
5,515,070 A 5/1996 Kawada
5,541,592 A 7/1996 Shiihara
5,546,492 A 8/1996 Ansley et al.
5,555,490 A 9/1996 Carroll
5,559,707 A 9/1996 De Lorme et al.
5,563,630 A 10/1996 Tsakiris et al.
5,572,401 A 11/1996 Carroll
5,576,687 A 11/1996 Blank et al.
5,581,492 A 12/1996 Janik
5,583,571 A 12/1996 Friedland
5,583,776 A 12/1996 Levi et al.
5,612,708 A 3/1997 Ansley et al.
5,636,122 A 6/1997 Shah et al.
5,644,324 A 7/1997 Maguire, Jr.
5,646,629 A 7/1997 Loomis et al.
5,647,016 A 7/1997 Takeyama
5,648,755 A 7/1997 Yagihashi
5,652,871 A 7/1997 Steinman et al.
5,661,632 A 8/1997 Register
5,675,524 A 10/1997 Bernard
5,682,525 A 10/1997 Bouve et al.
5,699,244 A 12/1997 Clark, Jr. et al.
5,719,743 A 2/1998 Jenkins et al.
5,719,744 A 2/1998 Jenkins et al.
5,732,074 A 3/1998 Spaur et al.
5,740,037 A 4/1998 McCann et al.
5,740,049 A 4/1998 Kaise
5,757,339 A 5/1998 Williams et al.
5,764,873 A * 6/1998 Magid et al. ..... 345/769
5,781,762 A 7/1998 Steinman et al.
5,781,913 A * 7/1998 Felsenstein et al. ..... 707/501
5,790,085 A 8/1998 Hergesheimer
5,790,974 A 8/1998 Tognazzini
5,798,907 A 8/1998 Janik
5,831,198 A * 11/1998 Turley et al. ..... 89/1.11
5,842,147 A 11/1998 Nimura et al.
5,848,373 A 12/1998 De Lorme et al.
5,864,481 A 1/1999 Gross et al.
5,872,539 A 2/1999 Mullen
5,873,070 A 2/1999 Bunte et al.
5,897,612 A 4/1999 Schwengler et al.
5,907,327 A * 5/1999 Ogura et al. ..... 345/339
5,911,773 A 6/1999 Mutsuga et al.
5,913,727 A 6/1999 Ahdoot
5,914,661 A * 6/1999 Gross ..... 340/600
5,914,686 A 6/1999 Schipper
5,928,304 A 7/1999 Priess
5,936,553 A 8/1999 Kabel
5,938,721 A 8/1999 Dussell et al.
5,950,137 A 9/1999 Kim
5,969,698 A 10/1999 Richard et al.
5,973,672 A 10/1999 Rice et al.
5,990,868 A 11/1999 Frederick
5,991,691 A 11/1999 Johnson
5,991,692 A 11/1999 Spencer, II et al.
5,994,710 A 11/1999 Knee et al.
6,128,002 A * 10/2000 Leiper ..... 345/156
6,235,420 B1 * 5/2001 Ng ..... 429/96
6,269,730 B1 * 8/2001 Hawkes et al. ..... 89/41.05
6,287,198 B1 * 9/2001 McCauley ..... 463/37

OTHER PUBLICATIONS

3DZoneMaster, www.mpog.com/reviews/hardware/controls/–techmedia/3dzone, (1997), p. 1–6.*

3DZoneMaster, "Game Controllers Enter A new Dimension" www.gamesdomain.co.uk/–gdreview/zones/review/hardware/–jan98/3dz_prnt.html (Jan. 1998), p. 1–3.*

3DZoneMaster Review, www.gamersu.com/reviews/hardware.sap?id=11, p. 1–2.*

Newton, Harry. Newton's Telecom Dictionary, 1998, Flatiron Publishing, p. 196.*

Web Site Printout, "Helmet Mounted Sight Oden", pp. 1–3, Dec. 12, 1996.

Web Site Printout, "Helmet–Mounted Sight Demonstrator", DCIEM, Dec. 6, 1996.

"Special Focus: High–Tech Digital Cameras", Photo Electronic Imaging, Jul. 1993.

"New Products", RGB Spectrum Video graphics Report, p. 2, Spring 1996.

* cited by examiner

INFANTRY WEARABLE INFORMATION AND WEAPON SYSTEM

GOVERNMENT INTERESTS

The present invention was conceived and developed in the performance of a U.S. Government Contract. The U.S. Government has certain rights in this invention pursuant to contract No. DAAB07-96-D-H002 S-2634 Mod 03A.

FIELD OF INVENTION

This invention relates to wearable systems for providing real-time situational awareness in battle or combat type conditions. More specifically, this invention provides hardware and software solutions to increase the efficiency and lethality of soldiers (or swat team members, for example) while simultaneously increasing the individual combatant's chances of survival.

BACKGROUND OF THE INVENTION

In recent years, there have been several attempts to develop a viable system for use in combat situations which would provide the modern soldier (or law enforcement officer etc.) with reliable enhanced tactical and communications ability in the hostile environment of armed conflict. In particular, attempts have been made to utilize technological advancement to provide an armed warrior with a system effective to improve the warriors lethality while simultaneously increasing his/her chances of survival. Unfortunately, previous attempts at developing such a system have been unacceptable in one respect or another.

One such attempt to create such a system is illustrated in U.S. Pat. No. 5,864,481, and is generally referred to as a Land Warrior (hereinafter "LW") system. In the '481 patent, a system is illustrated which combines a navigation, communication, and weapon system as a pre-packaged unit. This unit, as such, is further integrated into a specifically manufactured load carrying equipment (hereinafter referred to as "LCE") which incorporates body armor for protecting the wearer of the system (eg. the soldier). This integration enables a soldier to wear the system like a rather bulky backpack. Further, the LCE of the '481 patent functions as a platform for communication between the components of the LW system by fully integrating the wiring harness (for connecting the components) within its design.

In such a system, as described above, it is apparent that there are various drawbacks associated with its use and design. The design of the '481 system, for example, requires the use of the specifically developed and manufactured Load Carrying Equipment both for the integrated wiring (needed to operably connect the components of the system) and to accommodate the unit nature of the system (ie. the components are integrated into a "seamless" unit) which was designed to be carried in the specially designed LCE. Thus, the '481 system is not compatible and will not function with commercial-off-the-shelf (COTS) backpacks or government furnished equipment (GFE) ie. military issue vests or backpacks. Consequently, if the LCE of the aforementioned patent becomes dysfunctional or is otherwise rendered unusable, the entire system would be useless to a soldier (unless another LCE is available). In particular, this use requirement limits the very versatility such a system should be designed to achieve. This is because successful armed combat requires the utmost in flexibility and adaptability in order to provide a solider with a variety of options or avenues in each given combat or strategic situation.

Further to the issue of versatility, if a given component in the '481 system is damaged, the component may not be as readily replaced or repaired as would be desired in such high stress and time-sensitive conditions. Because the components of the prior art '481 system are enclosed within a metal shell structure on the LCE, they may not be accessed without removing the entire LCE from the wearer and opening up the shell. Further, once the interior of the metal shell of the LCE is accessed, the components of the prior art system are not easily removable and replaceable as would be preferred in such arduous and time-critical conditions ie. a component may not simply be unplugged and a new component plugged in. In addition, once the metal shell is open, every component within the shell is exposed to the elements rather than merely the component which must be accessed.

Still further, in wartime or other combat type situations, it is desirable that a soldier's equipment be tailorable to specific situations and or missions. This is because various types of missions require varying types of equipment. For example, if a specific component in such a system is not needed or desired because of the nature of a particular mission, it would be desirable to have the ability to quickly remove the unnecessary or unwanted component in order to reduce the weight of the system which the already burdened soldier must bear. Such a weight reduction can substantially improve the stamina and speed of a soldiers maneuvers, thus improving his/her chances of mission success. As aforesaid, the prior art '481 system requires that the entire metal shell of the LCE be taken apart in order to access the functional components of the prior art Land Warrior system. Further, once the interior of the shell is accessed, components are not easily removed or replaced. Because of this particular design, the LW system of the '481 patent is not well suited to a combat environment where equipment tailorability is needed.

As a further problem in the known Land Warrior system, no control device is provided which would enable a user to effectively and completely control the computer (and hence the system's components) while still allowing the user to maintain a combat ready stance and/or keep both hands on the weapon (preferably with access to the trigger). Instead there is provided in the LW system, only a simple, weapon-mounted switch which toggles between camera views (day or night views) and fires the attached laser range-finder.

In view of the above, it is apparent that there exists a need in the art for a new LW type system which either eliminates or substantially diminishes the drawbacks of the prior art. It is a purpose of this invention to provide such a system as well as to provide further improvements which will become more apparent to the skilled artisan once given the following disclosure.

SUMMARY OF THE INVENTION

Generally speaking, this invention fulfills the above-described needs in the art by providing: a portable, wearable, computerized system for collecting, coordinating, and communicating information, the system being capable of providing real-time situational awareness in armed conflict conditions, the system comprising:

a computer for operating the system;

a software interface for interacting with the computer;

an input/output device for interfacing the computer with the components of the system, the components including:

a display for displaying information processed by the computer;

a voiceless, wireless communications means; and a user position location device;

wherein the computer, the input/output device, and the components are each so designed so as to be quickly removable or replaceable such that the system is modular;

and wherein the system is adaptable to be wearable on a variety of existing commercial-off-the-shelf or government-furnished equipment, vests, packs, or body armor.

In another embodiment of the subject invention, there is provided: a portable, wearable, weapon-integrated computerized system for collecting, coordinating, and communicating information, the system being capable of providing real-time situational awareness in armed conflict conditions, the system comprising:

a computer for operating the system;

a software interface for interacting with the computer;

an input/output device for interfacing the computer with the components of the system, the components including:

a display for displaying information processed by the computer;

a voiceless, wireless communications means;

a user position location device; and a weapon communicably connected to the computer;

wherein the computer, the input/output device, and the components are each so designed so as to be removable or replaceable such that the system is modular;

and wherein the system is adaptable to be wearable on a variety of existing commercial-off-the-shelf or government-furnished equipment, vests, packs, or body armor.

In a further embodiment of the subject invention, there is provided: an input/output device for interfacing a computer with the components of a portable, wearable, computerized system for collecting, coordinating, and communicating information, the system being capable of providing real-time situational awareness in armed conflict conditions, the input/output device comprising:

voltage converters for converting power provided by an independent power source to voltages compatible with the components of the system, the voltage converters thereafter being capable of transmitting the converted power to the respective components; and data relays for routing data through the system; the data relays being capable of routing the data between the components and the computer of the system thereby permitting the components and the computer to communicate; wherein the input/output device is a self-contained unit with plug-in, plug-out connectors.

In a still further embodiment of the subject invention, there is provided: in a portable, wearable, weapon-integrated computerized system for collecting and coordinating information, the improvement comprising: a weapon mounted cursor control device for interfacing with a computer.

In yet another embodiment of the subject invention there is provided: a method of controlling a cursor with a weapon-mounted cursor control device in a portable, wearable, weapon-integrated computerized system for collecting and coordinating information, the method comprising:

positioning a cursor proximal a graphical object located at a first location on a computer display utilizing a mechanism for controlling a cursor;

selecting and picking up the graphical object at the first location by depressing and releasing a select button;

thereafter carrying the graphical object to a second location on the computer display utilizing the mechanism for controlling the cursor; and thereby releasing the graphical object at the second location by depressing and releasing the select button.

This invention will now be described with respect to certain embodiments thereof as illustrated in the following drawings wherein:

IN THE DRAWINGS

Figure 6A:
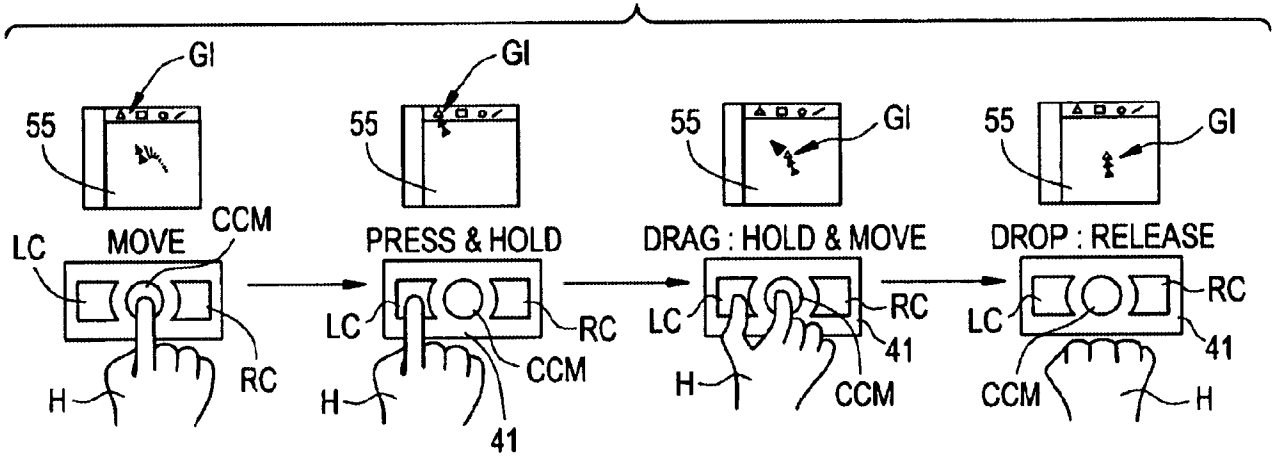
FIG. 6A PRIOR ART

FIG. 6*a* (prior art) is a sequential schematic view of the steps of the "Drag-and-Drop" method of cursor control of the prior art.

Figure 6B:
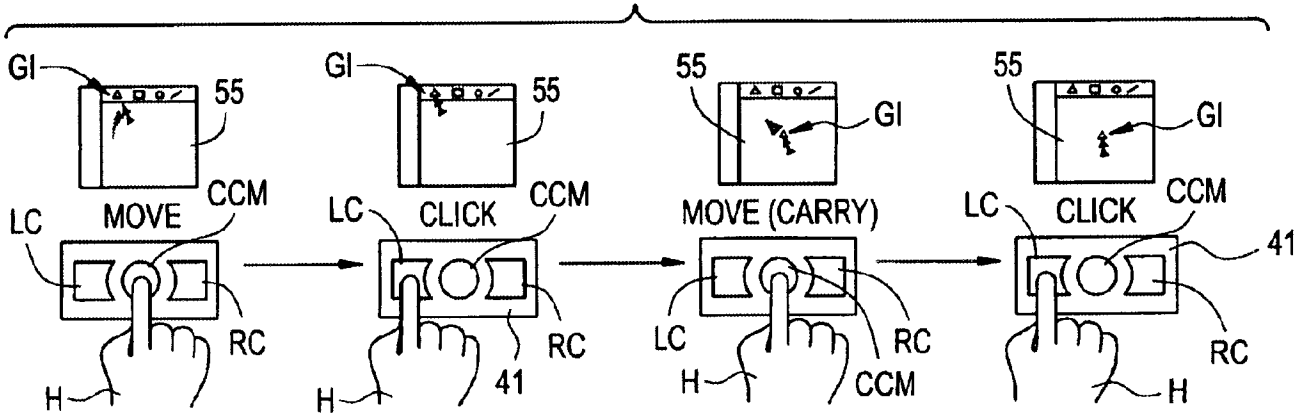

FIG. 6*b* is a sequential schematic view of the steps of a unique "Click-and-Carry" method of cursor control according to an embodiment of this invention.

Figure 6C:
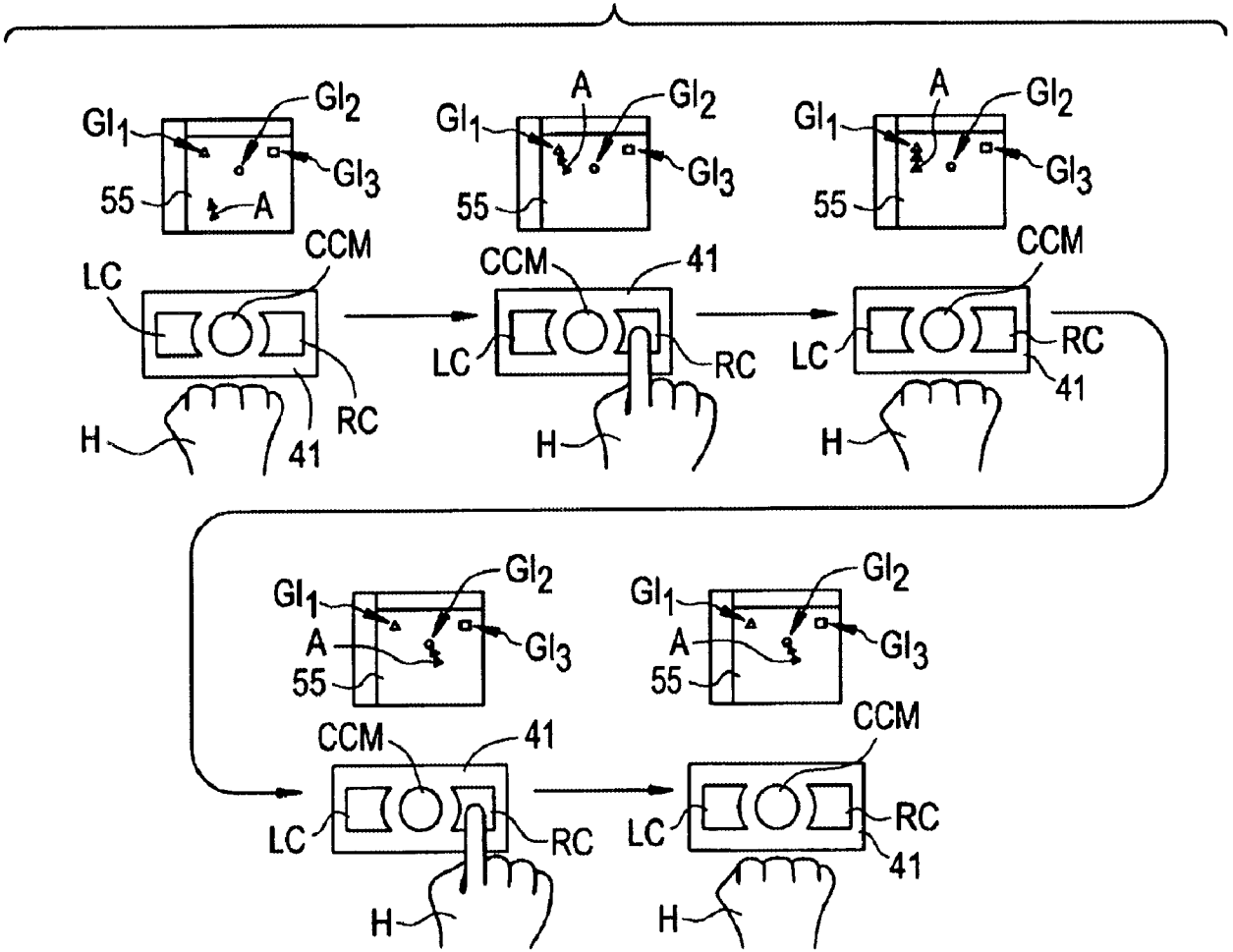

FIG. 6*c* is a sequential schematic view of the steps of a unique method of positioning a cursor according to this invention.

Figure 7:
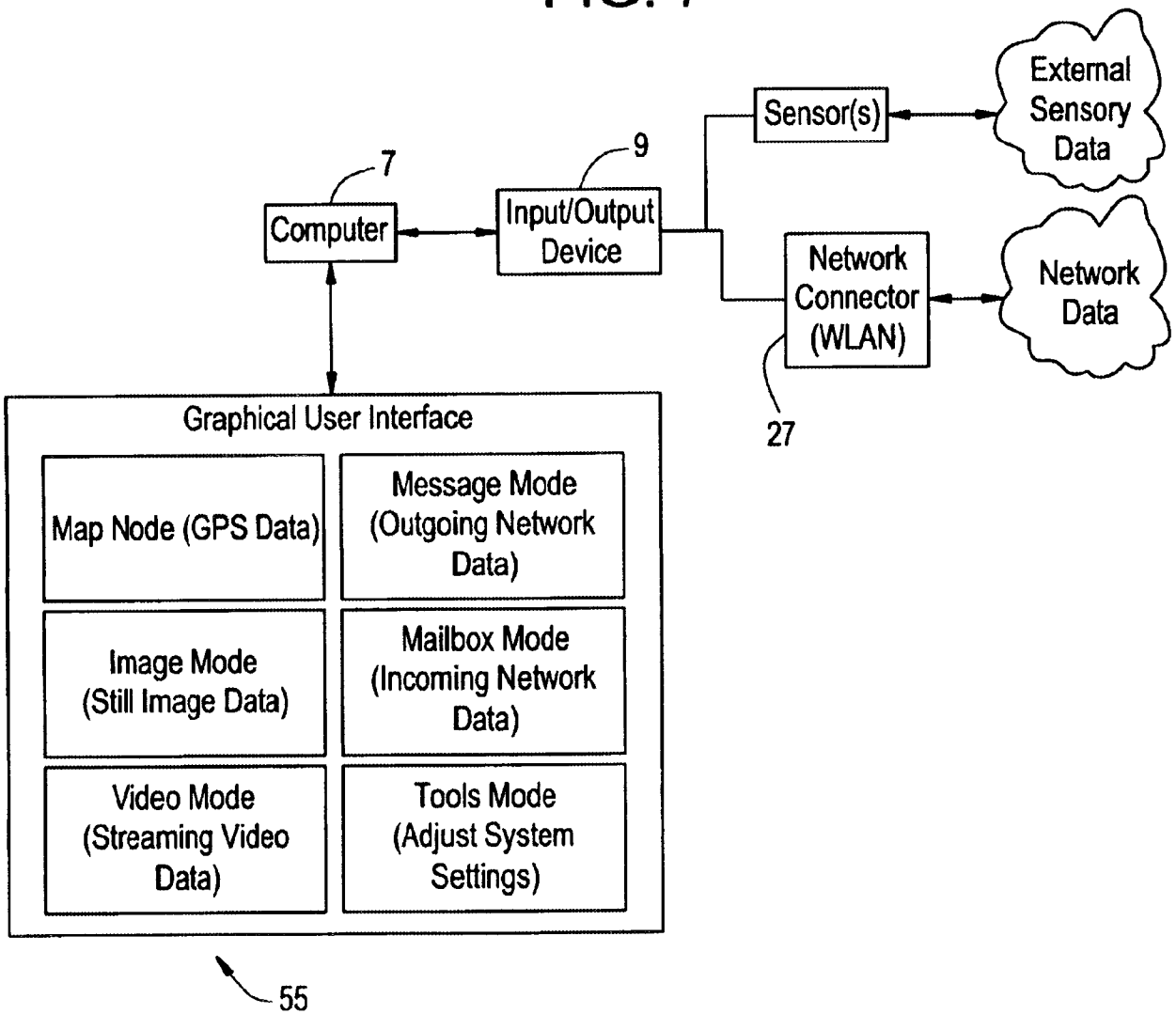

FIG. 7 is a diagrammatic view of an embodiment of a graphical-user-interface according to this invention.

Figure 8:
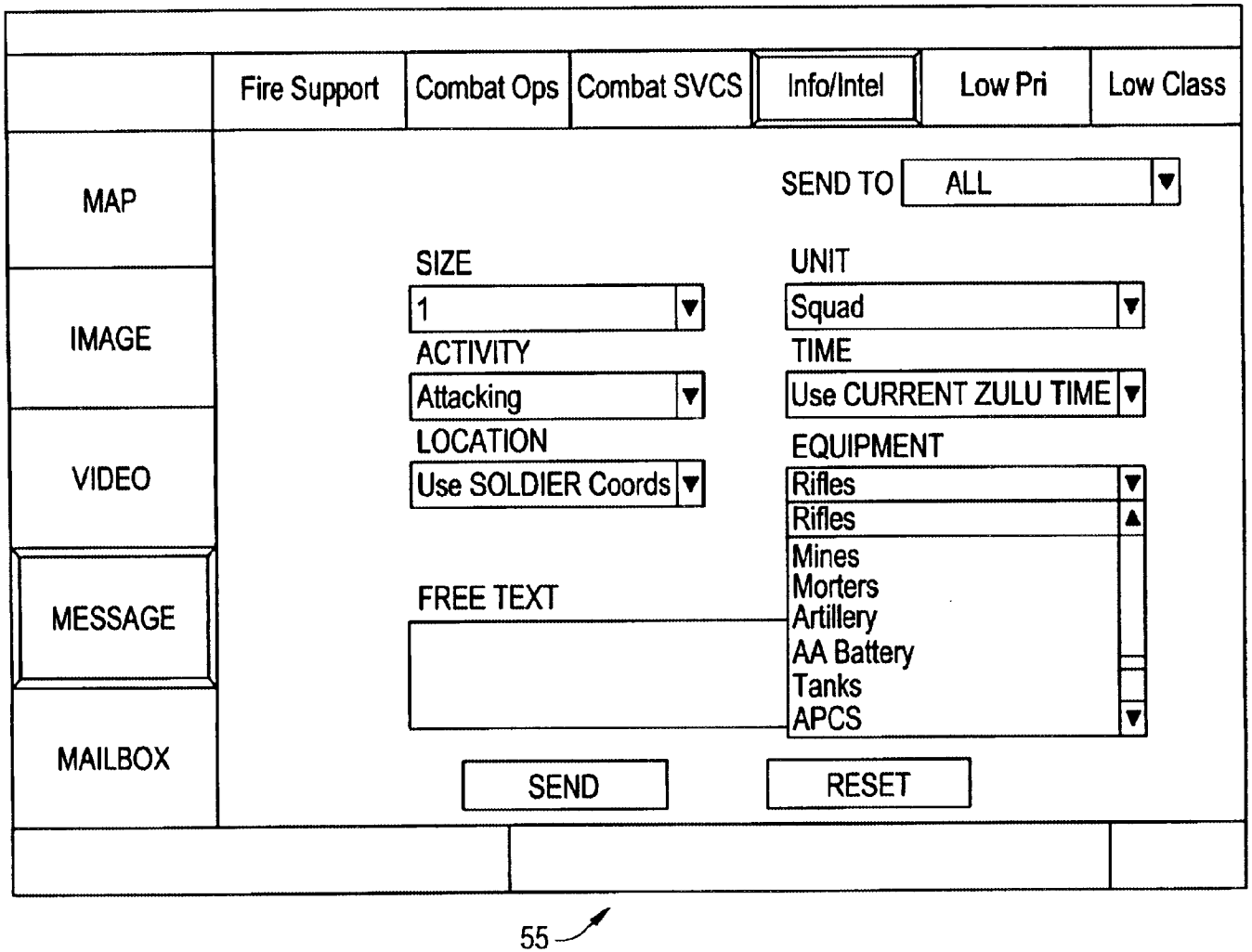

FIG. 8 is a diagrammatic view of an embodiment of a unique messaging interface according to this invention.

Figure 9:
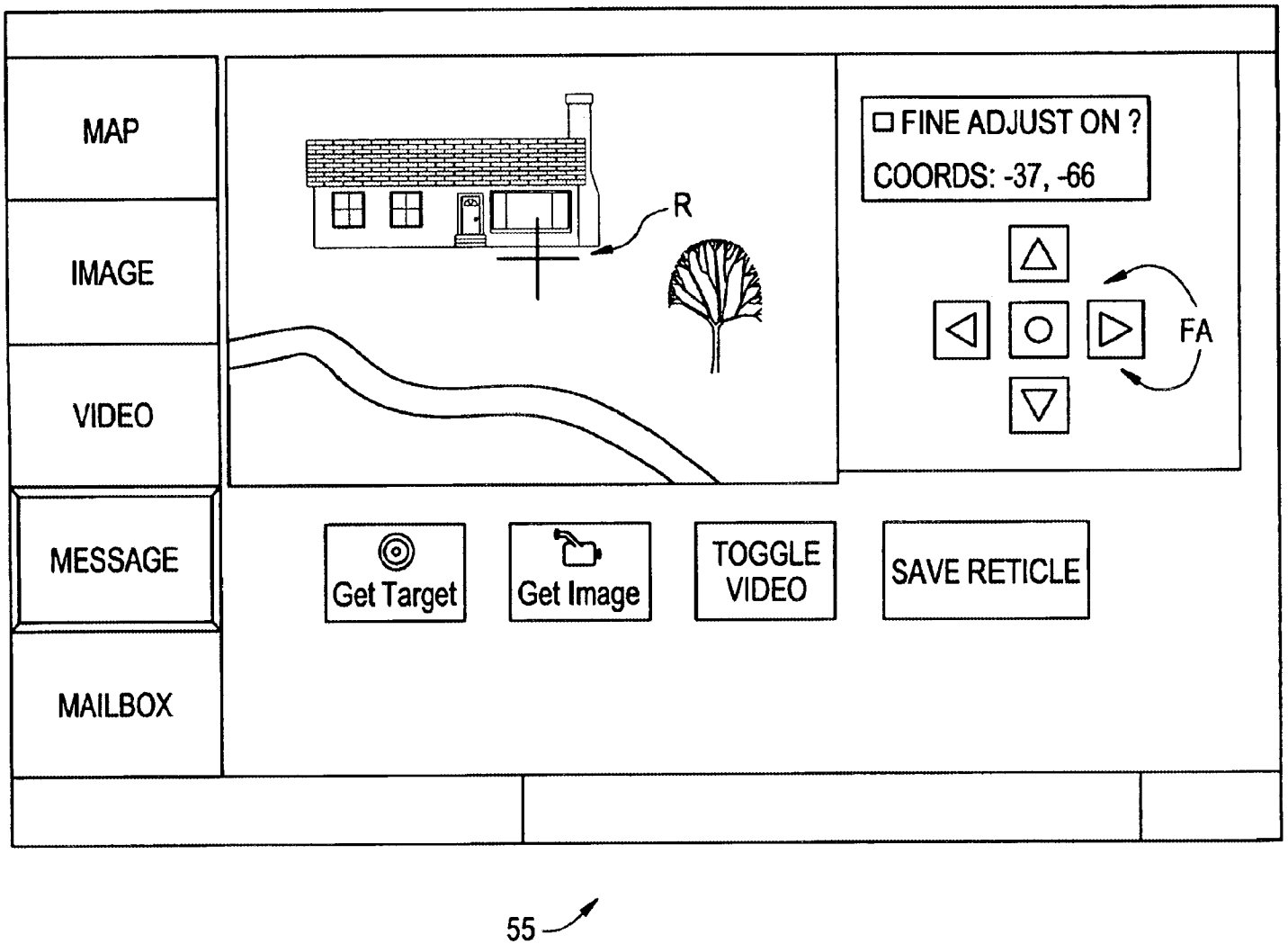

FIG. 9 is a diagrammatic view of an embodiment of the Video Mode of the graphical-user-interface of FIG. 7.

DETAILED DESCRIPTION

Figure 1:
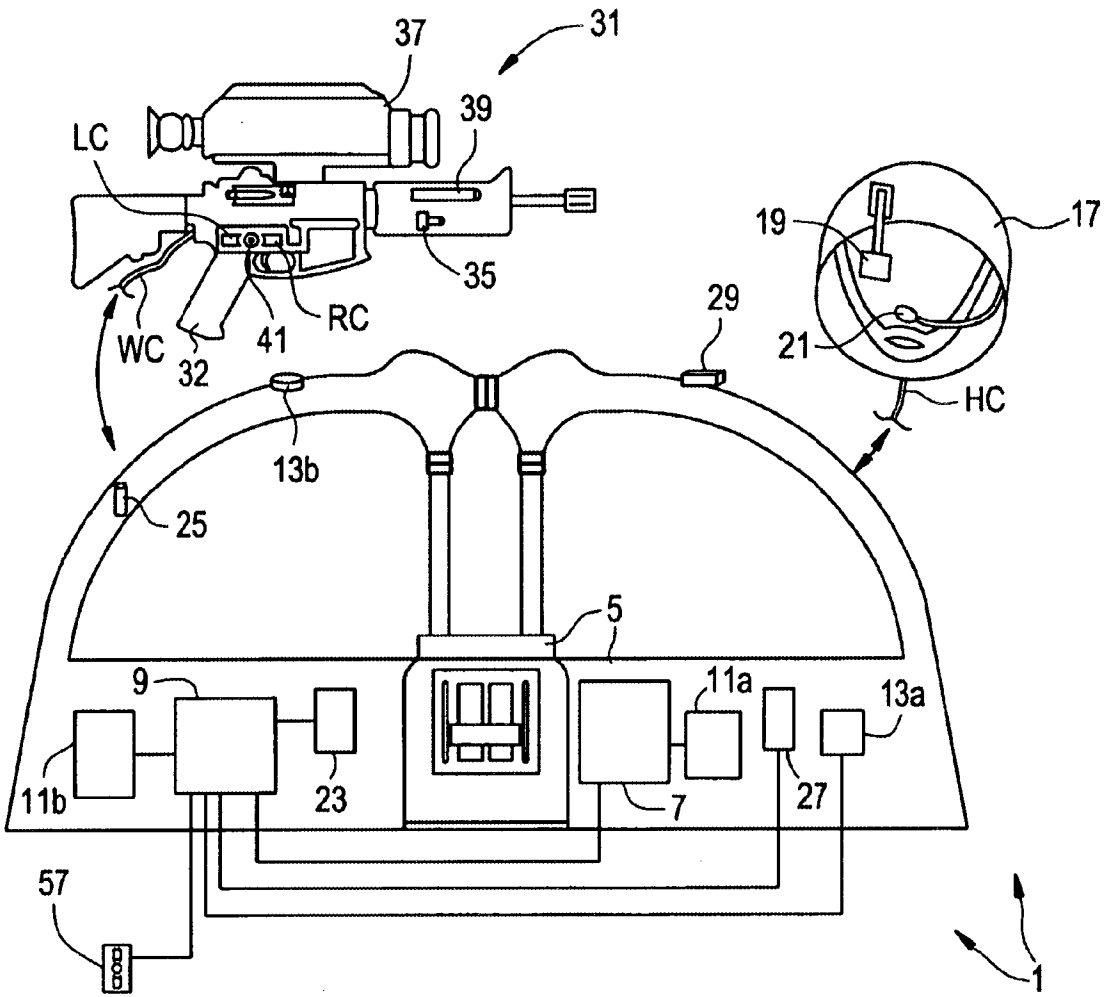
FIG. 1 is partial schematic view illustrating an embodiment of an Infantry Wearable Computer System according to this invention.
Figure 2:
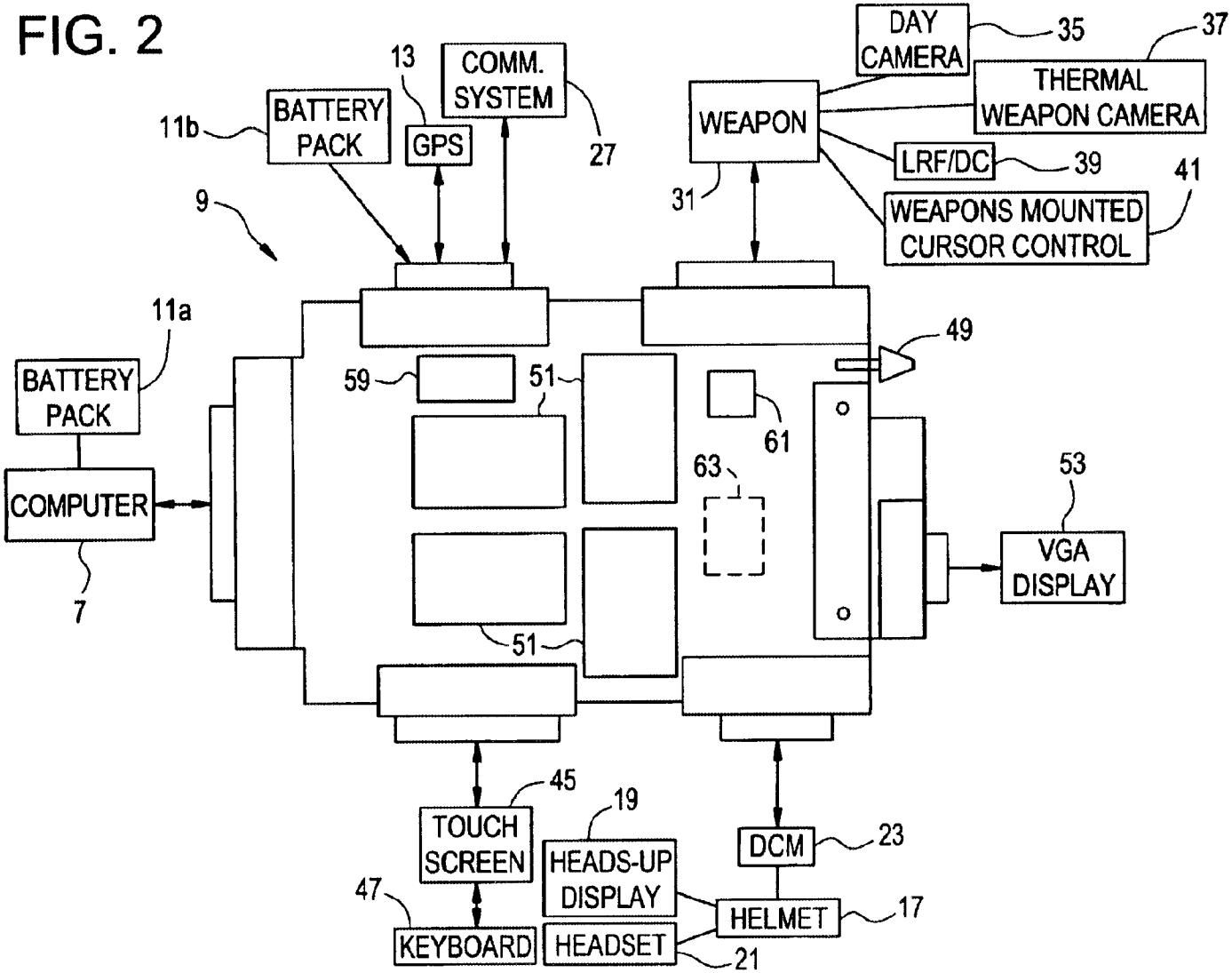
FIG. 2 is a schematic view of an input/output device useful as part of the Infantry Wearable Computer System of FIG. 1.

Referring initially to FIGS. 1, 2, and 7, there is illustrated a unique Infantry Wearable Computer System (IWCS) 1 which effectively and efficiently solves the aforesaid problems of the prior art. Generally speaking, Infantry Wearable Computer System 1 includes a wearable computer 7 (with software ie. graphical-user-interface 55) for operating and managing IWCS 1 which is communicably attached to a series of self-contained, peripheral components. These components communicate with computer 7 via unique input/output device 9, which is provided in order to route data and power between the peripheral components and computer 7. The peripheral components include, as tools for gathering, transmitting, and displaying information, ballistic helmet 17; wireless (WLAN) communications system 27; global positioning system (GPS) 13; and weapon 31. Battery packs 11*a* and 11*b* are provided to power both computer 7 and the various peripheral components of IWCS 1.

More specifically, as a component of IWCS 1, helmet 17 includes, mounted on its structure, heads-up monocular display 19 and headset 21, both as known and conventional in the art. Heads-up display 19 is provided so that a user is able to view the graphical-user-interface of the computer 7 or the various imagery provided by day camera 35 or thermal weapon sight camera 37 (as will be described in more detail below). Headset 21 is provided to permit voice communication between a user (ie. soldier) and the members of his/her squad. Data is transmitted to and from the components of helmet 17 and computer 7 via conventional helmet cable HC which attaches helmet 17 to input/output device 9.

In the illustrated embodiment, wireless communication system 27 is of circuit card architecture (eg. PCMCIA) but may be of any type as known and conventional in the art. In addition, system 27 includes WLAN antenna 29 whereby location coordinates, video, text-messages, maps, files and other types of data may be exchanged ie. transmitted and received between multiple Infantry Wearable Computer System 1 users (eg. in a particular squad or troop). With this wireless communication system 27, wearers of IWCS 1 are able to transmit such data (eg. range cards, drawings, strategic information, etc.) over the network in order to inform their fellow soldiers about enemy troop movement, target locations/descriptions, or emergent conditions for example. As a supplement to communications system 27, an independent, voice-only type radio (eg. manufactured by iCOM) is usually carried to permit verbal communication between soldiers.

In a preferred embodiment, voice may be communicated through communication system 27. In such an embodiment, audio digitizer 63 is provided (eg. in input/output device 9 as illustrated by the dotted lines in FIG. 2) whereby analog voice may be converted into data packets in a manner as known and conventional in the art. Optionally, audio digitizer 63 may be a stand-alone unit or may be integrated into other devices as desired. Once converted (ie. digitized), these data packets may thereafter be transmitted to other IWCS 1 users in the same manner as conventional digital data. Once transmitted, the data packets are converted back into analog by an audio digitizer (with software in a conventional manner) in the recipient's IWCS 1, whereby the recipient may thereafter hear the transmission as audible voice. Therefore, such an embodiment allows both voice and conventional data to be transmitted through a single communication system 27, thereby eliminating the need for carrying a separate, voice-only type radio.

Further included, for use with communication system 27, is conventional push-to-talk 25 which enables a user to control outgoing voice transmissions. When a IWCS 1 user desires to send voice communications, the user need only depress a button (not shown) on push-to-talk 25 (thus opening a radio channel). When the button is not depressed, the channel is closed and voice communications may not be sent.

Global position system 13 (ie. a user position location device) includes, as conventional in the art, receiver 13*a* (preferably with a PPS ie. Precise Positioning Service for increased accuracy) and antenna 13*b* whereby instant and accurate individual user location coordinates may be continually retrieved utilizing the NAVSTAR satellite system. Once retrieved, these coordinates are thereafter communicated to computer 7 where they are continuously (or periodically) transmitted via wireless communication system 27 to each of the other soldiers linked in the wireless network. Therefore, each IWCS 1 wearer, linked in a particular wireless network, is continually provided with the precise location of each fellow squad member (as well as his/her own location). These locations may be communicated to the soldier in various formats including as graphical displays on a map for example, as military grid reference system coordinates (MGRS), or simply as longitude and latitude coordinates (displayed on a graphical-user-interface).

In an alternative embodiment, GPS receiver 13*a* and wireless communication system 27 are combined into a single unit (not shown) with stand-alone capabilities (ie. with independent processing and power providing means). Specifically, when computer 7 is shut down, the combined GPS/communication unit is capable of continuing to transmit individual location coordinates as well as being capable of continuing to receive location coordinates from other IWCS 1 users (eg. squad members). Therefore, if computer 7 of a particular user is damaged, for example, the coordinates or position of the IWCS 1 user will still be retrievable by his/her squad members.

In order to enhance the combat abilities of the IWCS 1 user, weapon 31 (eg. a U.S. military issue M-4 automatic rifle), as a component of the system, is provided with various attached devices which are capable of gathering critical location, target, and strategic information and transmitting such information to attached computer 7. Each weapon mounted device communicates with computer 7 (through input/output device 9) via conventional weapon cable WC. The two-way arrow indicates such a communication ability. Specifically, these known/conventional attached devices include, but are not limited to, day video camera 35 (preferably a Daylight Video Sight), thermal (infrared) weapon sight camera 37, and laser range finder and digital compass assembly (LRF/DC) 39. In an alternative embodiment, a night vision system may optionally be provided. Each camera 35 and 37 is provided to gather video images for display on heads-up display 19. These images may further be saved/stored in computer 7 where they may later be manipulated (ex. drawn on) and/or transmitted to other soldiers (squad members). Additionally, aiming reticle R (ie. crosshairs), illustrated in FIG. 9, is provided and is displayed on top of live video images so that a user can effectively aim the weapon (or LRF/DC 39) over or around obstacles without exposing his/her body to enemy weapon fire. Laser range finder and digital compass assembly 39 is provided to gather navigational or target information in a manner as known and conventional in the art. For example, LRF/DC 39 may be used to determine target coordinates by combining the distance and directional data it acquires (when the laser is fired at a target) with the current individual user location coordinates as provided by global positioning system 13. Combining such information, exact target coordinates may be remotely determined from distances of more than several thousand meters. Further included on weapon 31 is weapon-mounted cursor control device 41, for controlling computer 7 and the components of IWCS 1, which will be described in more detail below.

In an alternative embodiment, high-resolution (eg. VGA) monitor 53 may be connected to input/output device 9 so that video (captured from cameras 35 or 37) may be viewed in greater detail when the IWCS 1 user returns to base camp. In particular, this would be useful for reconnaissance purposes or for training or teaching the individual user or other soldiers. Alternatively, IWCS 1 may be equipped with the ability to transmit live, high-resolution video to headquarters (or other remote location). This may be accomplished by attaching a transmitter to the high-resolution monitor connector/port (not shown) of input/output device 9. This ability would permit remotely located individuals (eg. senior military personnel) to view the field as through the eyes of individual soldiers (ie. through the various weapon mounted cameras). Thus, battle conditions and status could be actively monitored in real-time, allowing remote viewers to adjust battle strategy or change battle plans based on what is seen in such live images. Referring now to FIG. 2, a unique input/output device 9 is illustrated which is capable of interfacing computer 7 and battery packs 11*a* and 11*b* with each of the aforesaid independent, peripheral components of IWCS 1. More specifically, input/output device 9 is capable of transferring power and data between wearable computer 7 and battery packs 11*a* and 11*b* and the peripheral IWCS 1 components through simple plug-in connections (preferably ruggedized, quick-disconnect type connectors) provided on the casing of the device 9.

In order to perform its interfacing and power routing role, input/output device 9 must convert the 12 volts supplied by battery packs 11*a* and 11*b* to voltages appropriate for powering the individual components of IWCS 1. In order to carry out this role, input/output device 9 includes conventional voltage converters 51 (eg. manufactured by International Power Devices and Computer Products), to convert (ie. regulate) the voltage from battery packs 11*a* and 11*b* to +12 v, +6 v, +5 v, +3.3 v, and −3 v. In particular, these specific voltages are needed to power optional touch screen 45, day video camera 35, weapon mounted cursor control 41, and display control module 23 (which operates the heads-up display 19). In a preferred embodiment, and further included in a power routing role, on/off relay 59 is provided which turns on display control module 23 and day camera 35 automatically when computer 7 is turned on.

In a preferred embodiment of input/output device 9, audio digitizer 63 is provided to convert analog voice-data into digital voice-data. Utilizing this processor 63, voice may be transmitted as data packets through wireless communications system 27 to other IWCS 1 users.

In addition to routing power through its circuitry, input/output device 9 includes data relays (ie. a PC board) for routing data to and from computer 7 and the IWCS 1 peripheral components. In this regard, every communication made between computer 7 and the peripheral components must pass through input/output device 9 where it is thereafter routed to its appropriate destination.

Because input/output device 9 centralizes both power and data routing functions, changes or additions may be more easily made to the IWCS 1 assembly. For example, if several new components are to be added to the system, the current input/output device 9 may simply be swapped out for a new input/output device. Or, if a component breaks down and must be replaced, the defective component may simply be unplugged and a new component plugged in (using conventional connectors). In contrast, in the Land Warrior system, necessary power converters and data relays are non-centralized ie. built into the various integrated components of the system. Thus, if substantive changes need be made to the LW system, substantial changes may be required throughout the system including changes to the actual shell of the Load Carrying Equipment.

As a further advantage to the centralization of the power and data routing functions, commercial-off-the-shelf (or government furnished) components may be more easily used in the subject system. This is because individual components need not be specifically built or designed to function with the IWCS 1. Quite in contrast, input/output device 9 adapts to the needs of commercial-off-the-shelf components (rendering each compatible with IWCS 1). Therefore, the potential for upgrades and improvements in Infantry Wearable Computer System 1 is virtually unlimited.

Thus, as can be seen in the figures as illustrated, and unlike the LW system of the prior art, each component of Infantry Wearable Computer System 1 is a separate and distinct unit which is preferably individually ruggedized and weatherproofed and which may be individually accessed for repair or replacement. In addition, unlike the LCE integrated wiring harness of the LW system, the components of IWCS 1 communicate with computer 7 via conventional cabling and/or wires which may be routed or placed in any manner or location as desired for a particular use. In a preferred embodiment, the cables and/or wires are held in place with durable fabric cable/wire guides (eg. attached with Velcro™)

Further, unlike the prior art LW system, each component of IWCS 1 may be located ie. attached at any position about the body as may be desired by the individual user or users for functional or ergonomic reasons. In addition, each component can be carried by any suitable and conventional carrying means including commercial-off-the-shelf backpacks or vests or by government furnished equipment (GFE). As such, the present invention does not rely on the availability of specific carrying equipment, and, therefore, does not require that specific carrying equipment (ie. LCE) be manufactured for compatibility.

In the illustrated embodiment, for example, IWCS 1 is shown attached to a conventional MOLLE (modular, lightweight, load carrying equipment) vest 5 as issued by the U.S. military. Attached to such a vest 5, each component may be distributed around the body for even weight distribution (or simply according to personal preference) and may be easily accessed, replaced, repaired, or removed. In contrast, the prior art LW system may only be worn as a single, environmentally-sealed, integrated unit as part of the specially designed LCE. This is a distinct disadvantage in terms of cost, weight, versatility, and the ability to access components.

As a still further improvement over the prior art, IWCS 1 is, in addition, quickly tailorable to specific types of missions. Tailorability is possible because each component may be swapped out (ie. removed and replaced with another component) quickly and without disassembling the entire system 1 (or may simply be removed). For example, if less processor capability is needed for a mission, computer 7 may be swapped for a lighter and less powerful computer. This is accomplished by merely unplugging the unwanted computer and plugging in the desired new computer. This ability would enable a soldier to quickly reduce the load that he/she must carry for a given mission or combat scenario. Tailorability is made possible, in part, by input/output device 9 which itself may be swapped out if substantial changes to the IWCS 1 need be made.

Lending to the suitability of IWCS 1 for combat, and as another distinct advantage in the present invention, input/output device 9 is so wired (ie. in parallel) so as to permit hot swapping of battery packs 11*a* and 11*b* ie. the system does not have to be shut down when battery packs 11*a* and 11*b* are changed. In such an embodiment, an entire battery pack 11*a* or 11*b* may be detached from IWCS 1, while the remaining battery pack (11*a* or 11*b*) continues to provide power to the entire system (because power is routed through input/output device 9 in parallel). Thus, a complete battery pack (eg. 11*a*) may be removed and replaced without shutting down and rebooting the system.

Figure 3:
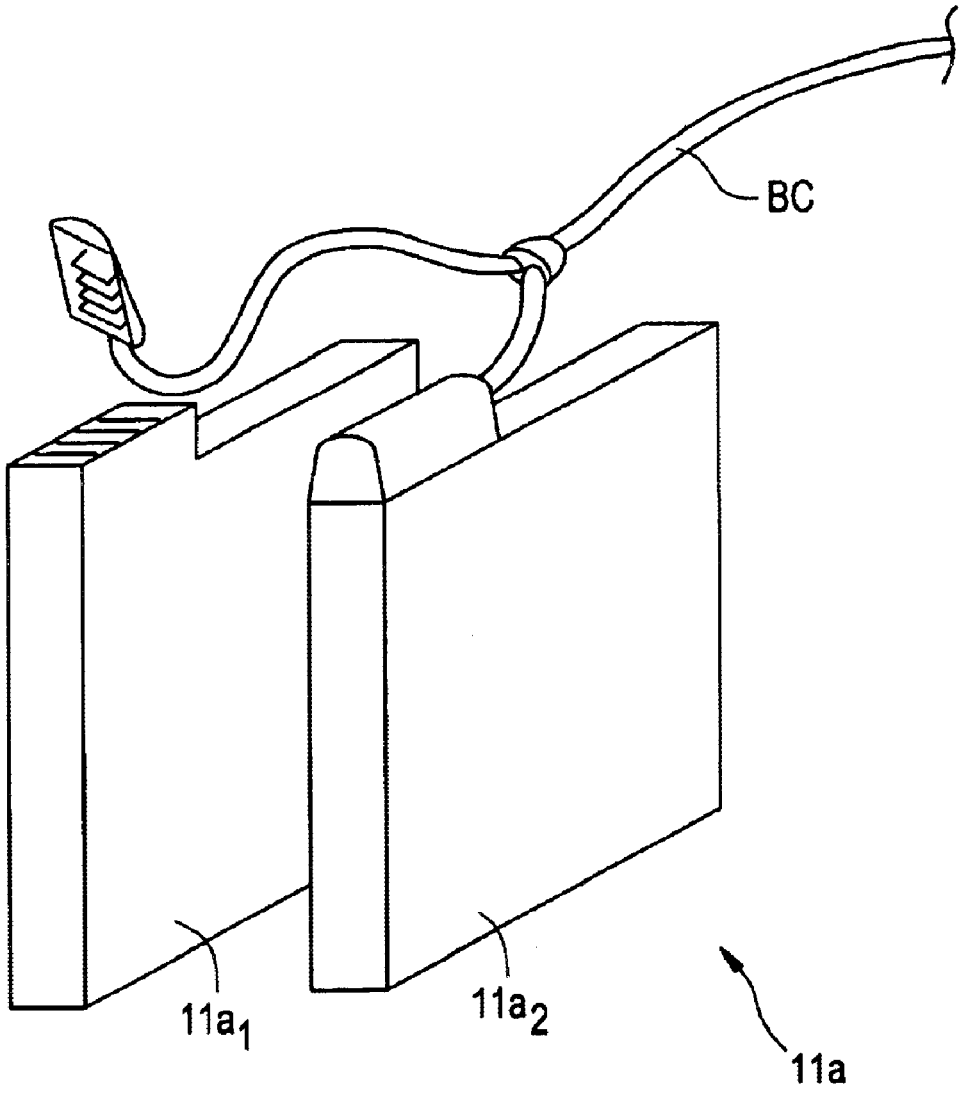
FIG. 3 is a three-dimensional view of a computer battery pack useful in the embodiment of FIG. 1.

In a preferred embodiment (illustrated in FIG. 3), each battery pack 11*a* and 11*b* includes two separable halves with each half comprising a stand-alone capable power supply. In such an embodiment, individual halves of battery packs 11*a* and 11*b* may be removed and replaced one at a time. This allows a battery pack to be replaced even if only one battery pack 11*a* or 11*b* contains a charge or is connected to the system (eg. a pack 11*a* or 11*b* is damaged or lost). For example, as illustrated in FIG. 3, battery pack 11*a* is split into two halves $11a_1$, and $11a_2$. Therefore, when battery pack 11*a* is nearly completely discharged, battery pack half $11a_1$ may be removed (ie. unplugged from battery cable BC) while the opposite battery pack half $11a_2$ provides continuous power to the system. This is possible even if battery pack 11*b* is completely discharged or removed from the system. The removed battery half $11a_1$ may thereafter be replaced with a fully charged battery half. Subsequently, this process may be repeated to replace the remaining (nearly discharged) battery pack half $11a_2$. Thus, in order to replace the rechargeable power supply of the subject invention, even when only a single battery pack 11*a* or 11*b* is functional or attached, the system does not have to be shut down and the computer rebooted. This is possible because input/output box 9 is so designed so that each battery pack 11*a* and 11*b*, and each half of each battery pack 11*a* and 11*b* is individually capable of powering the entire IWCS 1. This is unlike the LW system, in which, when a battery must be replaced, hot swaps are not possible, and the user must wait for the computer to shut-down and reboot.

In particular, the ability to hot swap is critical under battle conditions. If a soldier needs to replace a battery in a combat scenario, for instance, shutting down the computer would effectively render such a system useless and would cut the soldier off from the very communications and information sharing abilities that IWCS 1 was designed to achieve. It is clear of course, that cutting a soldier off from his/her sources of communication and information could jeopardize the life of the soldier and the ultimate success of the mission.

As further part of input/output device 9, and as an additional improvement over the prior art, switch 49 (FIG.2) is provided and permits toggling between the various views available for display on helmet-mounted, heads-up display 19. In this embodiment of the subject invention, as illustrated in FIGS. 1 and 2, the possible views for display on heads-up display 19 include those provided by day-camera 35, thermal weapon sight camera 37, and the computer display ie. graphical-interface 55. Thus, each one of these views may be accessed and shown full screen on the heads-up display 19 using switch 49. This is accomplished by merely rotating switch 49 to toggle to the desired view.

Video views (ie. camera views) may additionally be displayed in a "window" on GUI 55. These views may be switched (ie. from camera to camera) using conventional software controls (ie. a menu or button) provided in GUI 55. In order to provide such software switching capabilities, DTS switch 61 is provided in input/output device 9.

Also provided as a redundant means for interfacing with computer 7 are touch-screen 45 and keyboard 47 (both as known and conventional in the art). Each may be plugged into input/output device 9 (through conventional connectors) in order to provide a more user friendly means of controlling computer 7 when command of weapon 31 is not necessary (eg. at base camp).

As aforesaid, in the illustrated embodiment of the subject invention, weapon 31 is provided so that a wearer of Infantry Wearable Computer System 1 is capable of engaging in combat with the enemy. In addition, as briefly described above, weapon 31 preferably includes one of various embodiments of a cursor control device for interacting with and controlling computer 7. In contrast, in the prior art LW system, there is provided a toggle-type switch, mounted near the trigger of the prior art weapon, for controlling basic functions of the LW system including switching between heads-up display views and firing the laser range finder. If it is desired to perform more substantial functions in the LW system (such as creating and sending a message or creating a rangecard), a shoulder mounted remote-input-pointing-device must be used which requires that the user remove his/her hand from the weapon and away from the trigger. This would, of course, substantially reduce the LW system users reaction/response time if an emergent situation subsequently required aiming and firing the weapon.

Figure 4:
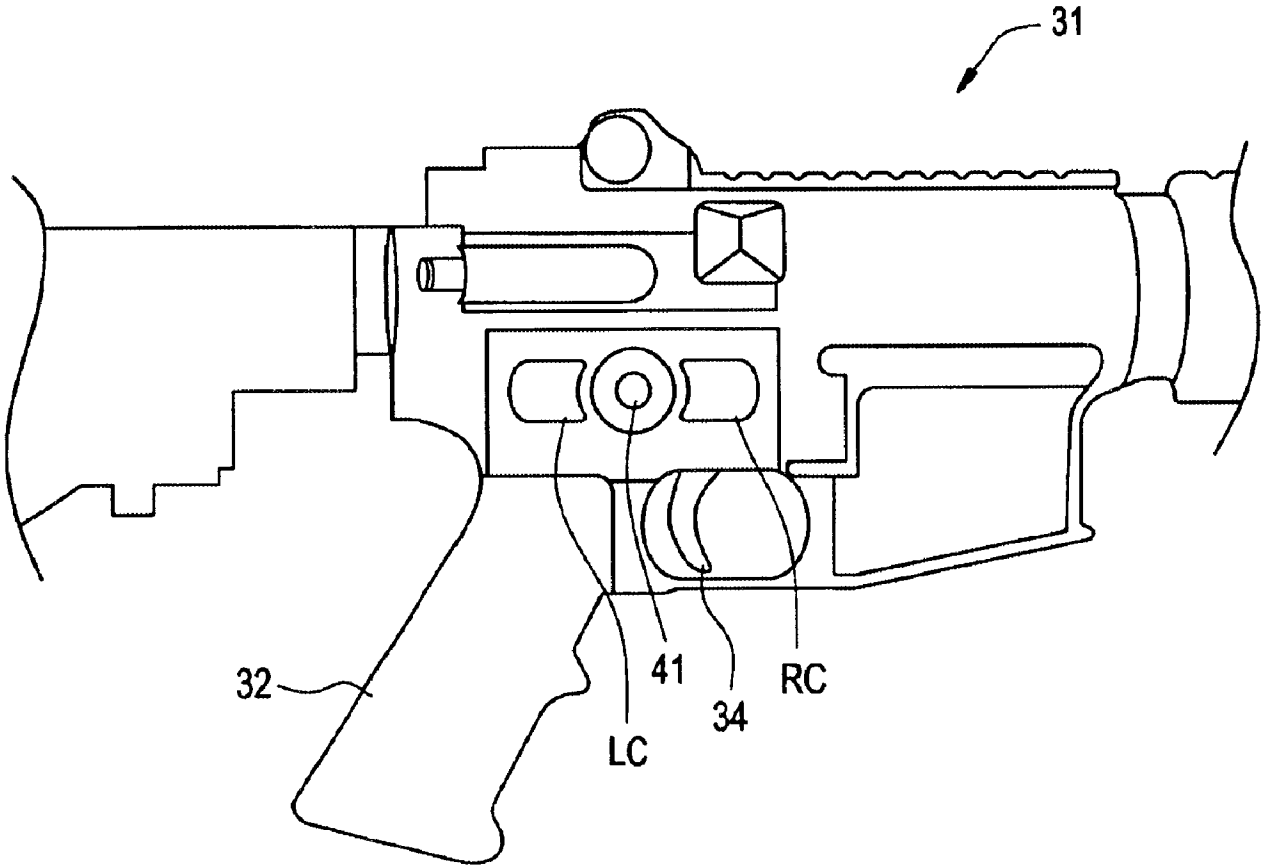
FIG. 4 is a partial, side-plan view of a weapon and a corresponding weapon mounted cursor control device according to on embodiment of this invention.
Figure 5:
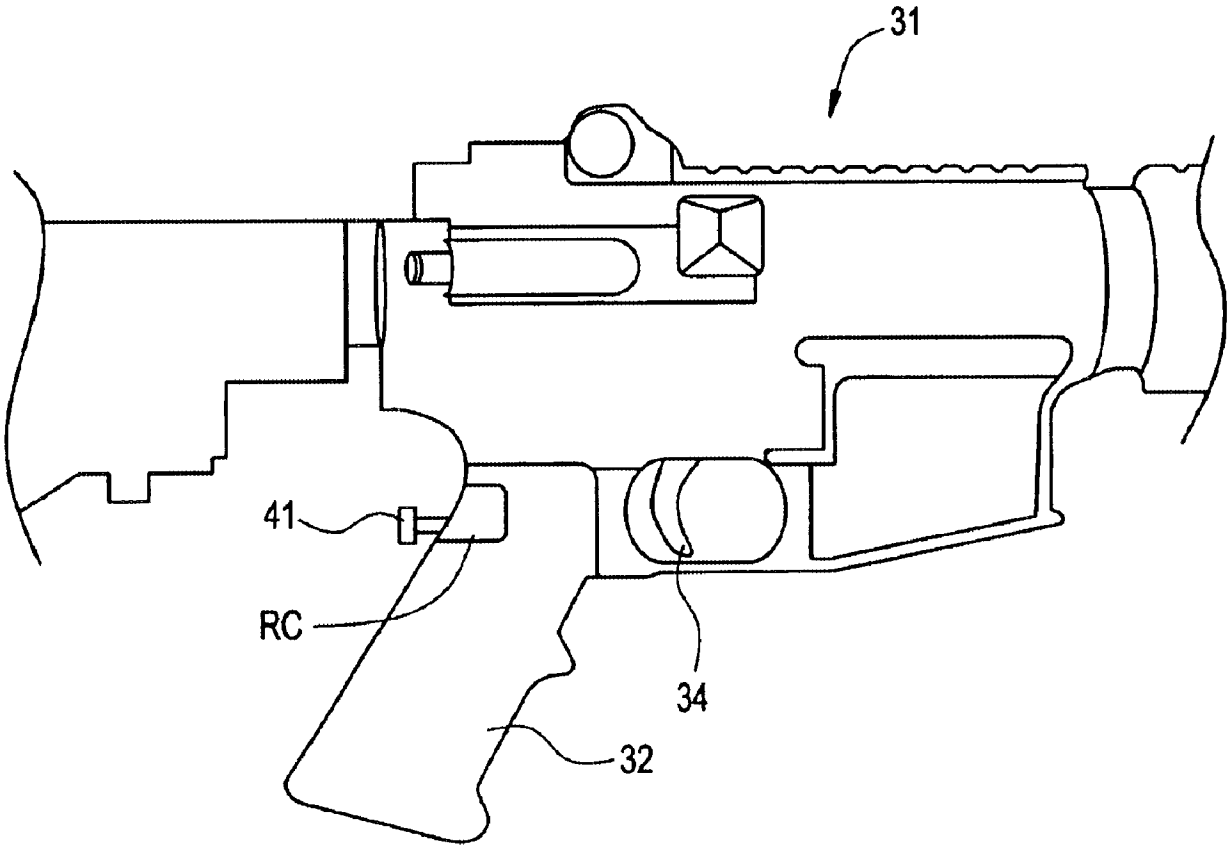
FIG. 5 is a partial, side-plan view of an alternative embodiment of the weapon mounted cursor control device of FIG. 4.

Provided, now, in the present invention, is a unique hardware and software solution, illustrated in FIGS. 4 and 5, which enables a user/soldier to control and interact with the entire IWCS 1 (or similar system) without requiring that the user remove his/her hand from the weapon. More specifically, weapon mounted cursor control device 41 is provided and functions in a manner similar to a conventional mouse. This mouse-type device may be one of several types of omni-directional button pads or miniature-joystick type devices which transmit signals as the "button" (or joystick) is manipulated with a finger. Alternatively, a "touch-pad" type device may be used which transmits signals as a finger is moved across the planar surface of a membrane (by sensing locations of changes in capacitance). In other embodiments of the weapon-mounted cursor control device 41, a "roller-ball" type cursor control may be used. Each cursor control device would preferably include left and right click buttons (LC and RC respectively) as known and conventional in the art. Regardless of the type of device used, each would be mounted in a location such that they could be used without requiring that the user remove his/her hands from the weapon. In one embodiment, for example, as illustrated in FIG. 4, weapon mounted cursor control 41 may be mounted next to the trigger for access by the index finger of the user. In an alternative embodiment, illustrated in FIG. 5, cursor control 41 may be mounted at the rear-center of weapon grip 32. This location would, of course, allow both right and left handed users to access cursor control 41 (with their thumb) and would not require that the user remove his/her index finger from the trigger of weapon 31. Such a rear-center mounted cursor control device would, of course, include right and left click buttons (RC and LC) also located on weapon grip 32.

In either case, a standard cursor control would be particularly difficult to use to manipulate and input information in the various screens of a graphical interface while still maintaining proper control of weapon 31 (eg. aiming the weapon). This is because standard "drag-and-drop" cursor controls require that a user utilize at least two fingers to perform many functions. Referring in this respect to FIG. 6*a*, the prior art drag-and-drop method of cursor control is illustrated in a sequence (the sequence representing a series of consecutive actions) of four sub-drawings representing the four basic steps involved in "picking-up" (ie. selecting) graphical icon GI at a first location (on a desktop) and moving and "dropping" graphical icon GI to a second location. As can be seen in these sequential sub-drawings, when moving an object or icon (eg. graphical icon GI) from one position on a desktop to another, the user (represented as hand H) first positions the cursor arrow (represented by an arrow in the drawings) over the particular object to be moved (using cursor control mechanism CCM eg. joystick, roller-ball etc). At this point, the user (ie. hand H) clicks and holds down a mouse button (usually left click button LC) to select the object (graphical icon GI, in this example). The user must then simultaneously move the cursor arrow (now carrying graphical icon GI) across the desktop (utilizing cursor control mechanism CCM while continuing to depress left click button LC), and then release the mouse button ie. left click button LC once graphical icon GI is in final position. Releasing left click button LC, in the "drag and drop" technique, drops the graphical object and completes the desired task/action. In order to simultaneously complete these actions, it is obvious that more than one finger need be used (to hold down left click button LC and simultaneously move the cursor using cursor control mechanism CCM), otherwise an object may not be effectively or accurately moved to a desired location. This technique, again, requires that the user lose at least some control of weapon, and is awkward, at best, for a user carrying a weapon.

Turning now, for comparative purposes, to the new and more efficient "click-and-carry" cursor control of the present invention, as illustrated in FIG. 6*b*, a graphical-user-interface (eg. GUI 55) may be used to input, access, and manipulate information without having to perform simultaneous actions using multiple fingers. FIG. 6*b* illustrates the "click-and-carry" method in a series of four drawings representing the four basic consecutive steps involved in "picking-up", moving, and ultimately relocating graphical object GI on a desktop.

In the "click-and-carry" cursor control of the present invention, a cursor arrow (represented by an arrow in the drawing) is first positioned (with the index finger of hand H, for example) using the cursor control mechanism of any cursor control device as disclosed here or as otherwise known in the art (eg. cursor control mechanism CCM). Once properly positioned, the same finger which was used to position the cursor arrow may be used to depress left click button LC to select the chosen action and/or "pick up" a graphical object/icon (ie. graphical icon GI in this example). Left click button LC may thereafter be released without dropping graphical icon GI (ie. completing the task or action). After releasing left click button LC, the graphical icon GI may then be carried across the desktop, utilizing the same finger (eg. index finger of hand H) to manipulate cursor control mechanism CCM. Once the cursor arrow and/or object (ie. graphical icon GI) is positioned appropriately on the desktop to properly complete the task, the user can, again, use the same (index) finger to depress left click button LC a second time and drop the graphical icon GI at the desired location on the desktop. Thus, as can be seen, in the present invention, when creating a range card by positioning targets on a coordinate map displayed by computer 7 (for example), only one finger need be used to carry target icons from a menu bar to the various desired locations on the coordinate map. As aforesaid, this "click-and-carry" software control enables a user of IWCS 1 (or similar system) to maintain better control of weapon 31 when manipulating a weapon mounted cursor control device such as device 41.

In another embodiment of the subject invention, a further improvement in cursor control is provided so that weapon-mounted cursor control device 41 (FIG. 4) may be more efficiently used. Typically in a graphical-interface, the user must manually direct/move the cursor arrow with a mouse type device so that the cursor arrow points to the particular object or tool bar button etc. that is desired to be used/selected. This is generally accomplished with a mouse type device (or touch pad or other device) ie. cursor control mechanism CCM by using a finger to drag/move the arrow across the desktop to the desired location. If the distance that the arrow must be moved across the desktop is substantial relative to the size of the desktop, time may be wasted both in moving and in accurately pointing the cursor arrow. Further, in a touch pad device, for example, moving/sliding the finger across the entire pad surface will usually not move the cursor arrow across the length or width of the entire desktop (depending on software settings). If the software settings are changed in order to increase the travel distance of the cursor arrow relative to finger movement, then the pointing device becomes substantially more sensitive, rendering the device difficult to accurately use ie. point (especially if holding and aiming a weapon).

In the improved and efficient software solution of the present invention, and with reference to FIG. 4, for example, the right click button RC (or, optionally, left click button LC) of the weapon-mounted cursor control device may be programmed to cause the cursor arrow to "jump" between the various toolbar buttons (or graphical icons) in a given screen when depressed. Turning now to FIG. 6*c*, this improved method of positioning a cursor arrow is demonstrated in a series of 5 sequential sub-drawings (as represented by the connecting arrows), setting forth the 5 basic (consecutive) steps involved in moving a cursor arrow from a random location on a desktop to a first graphical icon $GI_1$ and subsequently to a second graphical icon $GI_2$. As illustrated in FIG. 6*c*, when a particular screen of a user interface contains, on its display, various graphical icons ($GI_1$, $GI_2$, and $GI_3$) representing enemy targets, depressing the right click button RC (with the index finger of hand H) will cause the cursor arrow (represented by an arrow A in the drawings) to move substantially instantaneously ie. "jump" to the first target (ie. $GI_1$), in the sequence of targets (from its current position on the desktop). As shown in FIG. 6*c*, cursor control mechanism CCM need not be manipulated (eg. by a finger of hand H) to move the cursor arrow to this position. Preferably, each successive time fight click button RC is depressed as shown in FIG. 6*c*, the cursor arrow will jump to the next target (ie. $GI_2$) in the sequence of targets, thereby eliminating the need to be precise with cursor control mechanism CCM. If the particular screen contains a toolbar in addition to the graphical target icons, the cursor control interface (ie. software) may be programmed to cause the cursor arrow to "jump" to the buttons on the toolbar (not shown) once the cursor arrow has "jumped" to each target icon displayed on the screen. Thereafter, left click button LC may be depressed in order to "pick-up" the graphical icon or to select or activate a toolbar button. Therefore, by using this unique and efficient cursor control software technique, a user may navigate and manipulate a graphical-user-interface (eg. GUI 55) in a faster and more accurate manner; The difficulties normally inherent in positioning a cursor arrow (eg. when using a sensitive pointing device/cursor control mechanism in unusual or difficult environments or circumstances) are thereby overcome.

In alternative embodiments, right click button RC, for example, may be programmed to cause the cursor arrow to "jump" to any combination of graphical icons, buttons, or pull down menus, and in any order, depending, of course, on the desired use of the particular software application. In a further alternative embodiment of the subject invention, in order to accommodate both right and left handed users, left click button LC may be programmed to accomplish the "jump" function, with right click button RC being programmed to complete the typical "action" type function associated with a conventional left click button.

In a preferred embodiment of the subject invention, a back-up cursor control device is provided. This device may be belt-mounted cursor control 57 (FIG. 1), or alternatively, a chest or shoulder mounted device. In particular, belt-mounted cursor control 57 is provided in case of primary device (ie. weapon mounted cursor control device 41) failure.

Referring now to FIGS. 7–9, graphical-user-Interface (GUI) 55 is provided for controlling and interacting with IWCS 1. As illustrated, the diagram in FIG. 7 represents some of the various functions, modes, and data flows of the subject software. More specifically, FIG. 7 illustrates network data flow to and from GUI 55 (via WLAN 27 and input/output device 90), as well as data flow between GUI 55 and the various sensors (ie. peripheral components) of IWCS 1. In particular, GUI 55 is a software system (running on a Windows 98 platform, or, optionally, Windows NT or Windows 2000) which provides a unique, combat-oriented interface to enable the system wearer to utilize and control the various functions (eg. peripheral components) of IWCS 1 in an efficient and user-friendly manner. In this embodiment of the subject invention, GUI 55 may be controlled by one of the various embodiments of weapon-mounted-cursor-control 41, back-up belt-mounted cursor control 57, or optional touch-screen 45, or keyboard 47.

More specifically, GUI 55 generally comprises a software interface having five main modes including Map Mode, Images Mode, Video Mode, Message Mode, and Mailbox Mode. Further included, as a sub-mode, is Tools Mode which may be accessed with a "button" in the main screen of Map Mode. In order to access the different modes, conventional select "buttons" are displayed in each screen of GUI 55. In each of these modes, a user may interact with the various peripheral components of the system or may communicate with other soldiers or with a command station, or may adjust the various parameters of IWCS 1.

In the Map Mode, for example, various types of real image or graphical maps may be displayed such as topographical or satellite map images. Overlays may be displayed on top of these map images in order to provide the user with more detailed knowledge of specific areas. For example, sewer system blue prints or land mine locations may be displayed as overlays on top of more conventional map images. Further, both user and individual troop member locations are displayable in the map mode both as graphical icons or "blips" and as coordinates at the bottom of the display (eg. heads-up display 19). Troop locations are, of course, retrieved by the GPS 13 devices of the various IWCS 1 users (troops). Preferably, targets may also be displayed at their respective locations in the various map views. Simultaneously displaying both target and individual troop member locations enables the user to determine exactly his/her location with respect to such targets (and possibly navigate to such targets) without need for paper maps or traditional navigational or communication methods. In traditional military methods, each troop member/soldier writes down such target and individual location information on pieces of paper. This information must thereafter be hand-carried to the leader where it is ultimately combined into a single document which is eventually distributed to each of the individual soldiers or troop members.

Preferably provided in Map Mode, in order to enhance the options of the IWCS 1 user, are the abilities to: (1) zoom in and out on the various displayed map images i, (2) to selectively center a displayed map on individual troop members or targets, and (3) to digitally draw on or "click-and-carry" graphical icons onto the maps themselves. Thus, map views may be tailored to individual users as well as to individual missions or objectives. In addition, users may draw useful images on the displayed maps (using conventional software drawing tools), such as tactical attack routes, and silently transmit these combined map/drawings to other troop members over wireless communications system 27 of IWCS 1.

Also provided in Map Mode is the ability to transmit a call-for-fire message by simply "clicking" on a graphical image representing a target. Once this is done, the system confirms that a call-for-fire is desired and, if so, transmits such a message (including location coordinates) to command. In a preferred embodiment, when a call-for-fire message is sent, the user may indicate the type of weapon or artillery to be used for a particular target by simply selecting from a menu provided after the call-for-fire is confirmed.

As aforesaid, Tools Mode may be accessed with a "button" in the main screen of Map Mode. In the Tools Mode of GUI 55, files may be added or deleted by conventional software means. In addition, various IWCS 1 settings (eg. software or equipment settings) may be adjusted using conventional pull-down menus or buttons. This allows a user to customize GUI 55 for specific missions or merely for reasons of preference. For example, the GPS 13 location update rate may be changed or the default map (in Map Mode) specified.

In Images Mode of the subject GUI 55, various additional drawing devices are provided such as are known and conventional in the art e.g. a drawing tool bar with selections for line-thickness and color, for example. In particular, in this mode, drawings may be made or graphical icons placed over digital images retrieved from computer 7 memory. Alternatively, stored digital images (captured from cameras 35 or 37, or received from other troop members) may be viewed without utilizing the drawing tools or such graphical icons. These images, drawn on or otherwise, may thereafter be transmitted to other troop members or a command center or simply stored in computer 7 memory. In order to view and/or transmit or save these digital images, various conventional toolbars and pull-down type menus are provided.

In Message and Mailbox Mode of the subject invention, a user may create and send various types of communications, or a user may review communications which he/she has received from others over wireless network 27. For example, messages received from other IWCS 1 users may be read or edited much in the same manner as conventional e-mail. As such, these modes include a conventional text massage box along with conventional associated control "buttons" (ie. send, delete). Conversely, as a unique and useful feature of the subject invention, text messages may be created/drafted by IWCS 1 users utilizing a unique message interface without need for a keyboard.

More specifically, various (editable) pull-down menus are provided in Message Mode of GUI 55, whereby individual action specific or descriptive words may be selected and/or pasted to an outgoing message board or box. Each menu preferably contains words associated with a common subject matter. Various types of menus and any variety of subject types may, of course, be used depending on the desired use (eg. mission) of IWCS 1 or similar system. Utilizing these pull-down menus, whereby multiple descriptive or action specific words may be selected and pasted, messages may be composed without need for inputting ie. keying in individual letters using a keyboard. In a preferred embodiment for example, as illustrated in FIG. 8, a "SALUTE" type pull-down menu is provided. In such a menu, each letter of the word S-A-L-U-T-E is represented by the first letter in the subject titles "Size", "Activity", "Location", "Unit", "Time", and "Equipment" respectively. When a subject title is selected with a cursor control device, a menu appears presenting the user with a variety of subject related words for possible selection (and/or pasting). If the subject title "Activity" is selected, for example, the user will be presented with a selection of words related to the possible activities of the enemy. Thereafter, the user may select the desired word for displaying and/or pasting on the message board (or in a message box) by merely positioning the cursor and "clicking" on the specific word. Once the individual message is complete (by selecting the appropriate number and combination of words), the text message may be sent by simply selecting the intended recipients (using another pull-down menu) and then clicking a SEND button. Therefore, as can be seen, messages may be quickly composed and transmitted to select recipients using only a simple mouse, joystick, or touch-pad style device such as weapon-mounted-cursor control device 41 without requiring that individual letters be typed or keyed in. This is a substantial and important improvement over combat-oriented prior art messaging systems simply because a user never has to remove his/her hands from weapon 31 and/or carry extra pieces of equipment (eg. keyboard 47). It is understood, of course, that any type or combination of subject titles may be provided such as is appropriate for the individual use or situation. In an alternative embodiment, for example, military type "FRAG" orders may be composed and transmitted by the same method as described herein.

In Video Mode of the subject invention, users may select the view to be displayed (eg. on heads up display 19 or on touch screen 45) from one of cameras 35 or 37 using conventional software controls (ie. buttons or menus). Further, in Video Mode, still images may be captured from either live or stored (in memory) video. These images may thereafter be manipulated and/or saved or transmitted to other IWCS 1 users/troops. Also in Video Mode, laser range finder/digital compass 39 may be fired using the software controls of GUI 55. For this purpose, and also for aiming weapon 31 itself, reticle R is provided and superimposed on top of the video images as illustrated in FIG. 9. Thus, in order to aim weapon 31 or LRF/DC 39, a user need only point weapon 31 in the direction of the target while monitoring the video image (and reticle R) on heads-up display 19. When reticle R is positioned over the target, weapon 31 (or LRF/CD 39) is properly aimed and may thereafter be fired. This option, of course, allows users to aim LRF/DC 39 or weapon 31 around a corner, for example, without exposing the body of the user to harm. In this same mode, reticle R may be adjusted (ie. reticle R may be moved within the video image) with fine adjust software controls FA in order to fine-tune the aim of the system.

In a preferred embodiment, in each mode of GUI 55, user location coordinates (retrieved from GPS 13) are always displayed at the bottom of the screen (not shown). GUI 55 may, of course, display any number of coordinates at this location, including individual troop member or target coordinates.

Once given the above disclosure many other features, modifications and improvements will become apparent to the skilled artisan. Such other features, modifications and improvements are therefore considered to be a part of this invention, the scope of which is to be determined by the following claims:

We claim:

1. A portable, wearable, weapon information system for collecting, coordinating, and communicating information, said system being capable of providing real-time situational awareness in armed conflict conditions, said system comprising:

a power supply;

a computer for controlling functions of said apparatus;

a software interface for interacting with said computer;

a display for displaying information processed by said computer;

a weapon communicably connected to said computer, and having a trigger for firing said weapon;

said weapon having a grip for handling said weapon, said grip located adjacent said trigger; and said weapon having a barrel including a bore, said bore having an axis extending longitudinally therethrough;

wherein said software interface is controlled by a weapon mounted cursor control device mounted on said weapon, said weapon mounted cursor control device comprising:

a control mechanism for positioning a cursor, said control mechanism being so located on a rear facing portion of said grip such that both a right and left handed user can access said control mechanism employing a thumb while maintaining contact with said trigger with a finger; and an actuating mechanism for performing control, selection, and action functions on said software interface; and wherein said weapon mounted cursor control device is communicably connected to a first software interface embodied in a computer readable medium, said first software interface providing a click-and-carry method of cursor control and including a cursor and graphical icons, said click-and-carry method comprising in sequence:

orienting said cursor at a first location proximal a graphical icon displayed on said first software interface;

depressing said actuating mechanism to select said graphical icon;

releasing said actuating mechanism;

orienting said cursor at a second location physically separate from said first location;

depressing said actuating mechanism to release said graphical icon at said second location.

2. The apparatus according to claim 1 further including a second software interface comprising:

at least one pull-down menu containing words being alternately descriptive of combat scenarios and directives;

a message window for receiving and displaying words selected from said pull-down menu;

means for selectively transmitting a message contained in said message window.

3. The apparatus according to claim 2 wherein said words which are contained in said pull-down menu may be input by a user.

4. The apparatus according to claim 1 wherein said control mechanism comprises a joystick for access by a thumb of a user.

5. A portable, wearable, weapon information system for collecting, coordinating, and communicating information, said system being capable of providing real-time situational awareness in armed conflict conditions, said system comprising:

an input/output device for interfacing said computer with components of said system, said components including:

a display for displaying information processed by said computer;

a voiceless, wireless communication means; and a user position location device;

a power supply;

a computer for controlling functions of said apparatus and having a software interface for interacting with said computer;

wherein said apparatus further includes a weapon communicably connected to said computer, and having a trigger for firing said weapon, said weapon having a grip for handling said weapon, said grip located adjacent said trigger; and said weapon having a barrel including a bore, said bore having an axis extending longitudinally therethrough;

wherein said software interface is controlled by a weapon mounted cursor control device mounted on said weapon, said weapon mounted cursor control device comprising:

a control mechanism for positioning a cursor, said control mechanism being so located on a rear facing portion of said grip such that both a right and left handed user can access said control mechanism employing a thumb while maintaining contact with said trigger with a finger; and an actuating mechanism for performing control, selection, and action functions on said software interface;

wherein said input/output device comprises:

voltage converters for converting power provided by a power source to voltages compatible with said components of said system, said voltage converters thereafter being capable of transmitting said converted power to said components; and data relays for routing data between said computer and said components thereby permitting said components and said computer to communicate;

a plurality of universal, plug-in, plug-out connectors for receiving universal connectors of said components, said universal, plug-in, plug-out connectors further providing means for quickly removing a said component and thereafter replacing said component with a new component, wherein said new component connects to said input/output device via a universal connector; and wherein said weapon mounted cursor control device is communicably connected to a first software interface embodied in a computer readable medium, said first software interface providing a click-and-carry method of cursor control and including a cursor and graphical icons, said click-and-carry method comprising in sequence:

orienting said cursor at a first location proximal a graphical icon displayed on said first software interface;

depressing said actuating mechanism to select said graphical icon;

releasing said actuating mechanism;

orienting said cursor at a second location physically separate from said first location;

depressing said actuating mechanism to release said graphical icon at said second location.

6. The apparatus according to claim 5 further including a second software interface comprising:

at least one pull-down menu containing words being alternately descriptive of combat scenarios and directives;

a message window for receiving and displaying words selected from said pull-down menu;

means for selectively transmitting a message contained in said message window.

7. The apparatus according to claim 6 wherein said control mechanism comprises a joystick for access by a thumb of a user therefore enabling the user to maintain a finger on said trigger while operating said joystick.

8. The apparatus according to claim 5 wherein said input/output device further includes digital/analog data converting means.

9. The apparatus according to claim 8 wherein said input/output device further includes video format converting means.

* * * * *